US011814793B2

(12) United States Patent
Viitasalo et al.

(10) Patent No.: US 11,814,793 B2
(45) Date of Patent: Nov. 14, 2023

(54) ELONGATED COMPONENT FOR A MANUFACTURING MACHINE OF A FIBROUS CELLULOSIC WEB, ITS USE AND METHOD FOR RECYCLING

(71) Applicant: Valmet Technologies Oy, Espoo (FI)

(72) Inventors: Pasi Viitasalo, Jyväskylä (FI); Mikko Kaasalainen, Jyväskylä (FI)

(73) Assignee: Valmet Technologies Oy, Espoo (FI)

( * ) Notice: Subject to any disclaimer, the term of this patent is extended or adjusted under 35 U.S.C. 154(b) by 0 days.

(21) Appl. No.: 17/844,549

(22) Filed: Jun. 20, 2022

(65) Prior Publication Data

US 2022/0403596 A1 Dec. 22, 2022

(30) Foreign Application Priority Data

Jun. 22, 2021 (FI) ..... 20215732

(51) Int. Cl.

| | |
|---|---|
| ***D21G 3/00*** | (2006.01) |
| ***D21F 1/02*** | (2006.01) |
| ***D21F 1/52*** | (2006.01) |
| ***D21F 3/02*** | (2006.01) |
| ***D21F 3/10*** | (2006.01) |

(52) U.S. Cl.

CPC ..... *D21G 3/005* (2013.01); *D21F 1/02* (2013.01); *D21F 1/523* (2013.01); *D21F 3/0272* (2013.01); *D21F 3/105* (2013.01)

(58) Field of Classification Search

CPC .. D21G 3/005; D21G 3/00; D21F 1/02; D21F 1/523; D21F 3/0272; D21F 3/105; D21F 1/028; D21F 1/483; D21F 3/10; D21F 1/48; D21F 1/10

See application file for complete search history.

(56) References Cited

U.S. PATENT DOCUMENTS

| | | | | |
|---|---|---|---|---|
| 2013/0139988 | A1* | 6/2013 | Draper | D21G 3/005 977/773 |
| 2014/0023846 | A1* | 1/2014 | Draper | D21G 3/005 428/220 |
| 2021/0388201 | A1* | 12/2021 | Lehtonen | C08K 7/14 |

* cited by examiner

*Primary Examiner* — Eric Hug
*Assistant Examiner* — Matthew M Eslami
(74) *Attorney, Agent, or Firm* — Stiennon & Stiennon

(57) ABSTRACT

An elongated planar or profiled component for a manufacturing machine of a fibrous cellulosic web, such as paper, board or tissue web, is at least partially formed from a composite material having a continuous polymer matrix, and reinforcing inorganic fibers embedded in the continuous polymer matrix. The continuous polymer matrix is biodegradable and the reinforcing inorganic fibers are biodegradable glass fibers. A method is disclosed for recycling elongated planar and/or profiled components used for manufacture of a fibrous web.

10 Claims, 2 Drawing Sheets

ELONGATED COMPONENT FOR A MANUFACTURING MACHINE OF A FIBROUS CELLULOSIC WEB, ITS USE AND METHOD FOR RECYCLING

CROSS REFERENCES TO RELATED APPLICATIONS

This application claims priority on Finnish Application No. 20215732, filed Jun. 22, 2021, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to an elongated component for a manufacturing machine of a fibrous cellulosic web and to its use, its recycling.

Cellulosic fibrous webs, such as paper, board, tissue, and the like, are produced in processes where a number of apparatuses are arranged consecutively in a process line. A typical process line comprises at least a headbox, a wire section, a press section, a drying section and a reel-up. The process line can further comprise treatment sections for surface sizing, coating, and calendering of the formed fibrous web.

The process line, its sections and apparatuses comprise various elongated planar or profiled components, such as doctor blades, headbox sheets and rod beds. The conventional elongated components are made from various materials, such as plastics, fiber reinforced plastic laminates or from plastic containing composite materials. Many of these elongated components are susceptible to wear, and they must be replaced at regular intervals in order to maintain the proper functioning of the process line and the quality of the produced fibrous web. Often the used elongated components are just treated as waste and discarded.

The fees for depositing used or discarded material in waste disposal sites are generally increasing in an attempt to encourage businesses to find alternative solutions to waste management. At the same time, there is a general trend in society to reduce the use of fossil-based materials, such as plastics. A specific concern is the formation of microplastics, which easily pollute aquatic environments, such as rivers, lakes and seas. It is possible that during the use of the elongated components in the manufacture of fibrous webs microplastics are formed and freed into the circulating waters of the process line. There is a risk that they may even escape outside the manufacturing process, e.g. through wastewater treatment process.

In view of the above, there is a need to find new, more sustainable materials for elongated components, which would make them more environmentally friendly and easier to dispose of.

It is an object of the present invention to minimize or even eliminate the disadvantages existing in the prior art.

An object of the present invention is to provide elongated planar or profiled components that enable easy and effective recycling or disposal of used components.

A further object of the present invention is to improve sustainability of the manufacturing process of the cellulosic fibrous webs and/or make it more consistent with the values of a circular or recycling economy.

All the described embodiments and advantages apply to the components used as well as the method according to the present invention, when applicable, even if not always explicitly stated so.

SUMMARY OF THE INVENTION

A typical elongated planar or profiled component according to the present invention for a manufacturing machine of a fibrous cellulosic web, such as a paper, board or tissue web, which elongated component is at least partially formed from a composite material, comprises

- a continuous polymer matrix, and
- reinforcing inorganic fibers embedded in the continuous polymer matrix, wherein the continuous polymer matrix is biodegradable, and the reinforcing inorganic fibers are biodegradable glass fibers.

A typical use of an elongated planar or profiled component according to the present invention is in the manufacture of paper, board, tissue, or fiber webs.

A typical method according to the present invention for recycling elongated planar and/or profiled components used for manufacture of a fibrous web, such as paper, board, tissue, or the like, comprises

- collecting first elongated planar and/or profiled components according to the present invention which are at least partially formed from a composite material,
- processing the composite material of the first elongated planar and/or profiled components into a starting composite material comprising biodegradable polymer(s) and biodegradable glass fibers, and
- forming the starting composite material into second elongated planar and/or profiled components suitable for use in the manufacture of fibrous cellulosic webs and comprising biodegradable glass fibers embedded the biodegradable polymer matrix.

Now it has been surprisingly found that elongated components that are used in manufacturing machines for fibrous cellulosic webs can be at least partially made of composite material comprising a biodegradable continuous matrix and inorganic fibers which are biodegradable glass fibers. It was highly unexpected that the fully biodegradable composite material is able to withstand the conditions prevailing at the manufacturing machine for a sufficiently long time without excessive deterioration. The use of biodegradable composite for elongated components makes it possible to recycle the used components into new components as long as the mechanical properties are satisfied, and then the components can be sustainably disposed of, e.g., by composting. This significantly decreases the amount of waste that is produced in the manufacturing process itself. Use of biodegradable composite also minimizes or reduces the risk for microplastics contamination due to the wear of the elongated components during their use. Even if microparticles of composite material would be liberated due to wear into the circulating process waters, they will be degraded into harmless environmentally acceptable components.

Furthermore, it has been unexpectedly observed that the use of composite material which comprises a biodegradable continuous matrix and reinforcing inorganic fibers selected from biodegradable glass fibers may improve performance of the elongated components. It has been found that the material thickness in the components could be in some cases reduced, while at least maintaining or even improving the process performance of the elongated component.

In the present context the term "elongated planar or profiled component" denotes any component used in manufacture of a fibrous cellulosic web, such as paper, board, tissue or the like, which has a length that corresponds to the full-width or the part-width of the cellulosic web. The elongated component thus has typically a length of 0.5-12 m, more typically 6-10 m. The elongated component usually extends over the whole width of the web to be produced, either continuously or discontinuously, equally over both edges of the web. The elongated component is usually arranged detachably mounted to the fiber web manufacturing machine with suitable connections or connectors, e.g., holders, clamps, bolts, or the like, and most often the elongated component can be removed/installed from the tending side of the machine by pulling/pushing or sometimes by lifting, especially if it is connected by bolts or the like. The other dimensions of the elongated component, width and height, are always significantly less than its length.

The elongated component according to the invention may be a planar component or a profiled component. Elongated planar components typically have two parallel large surfaces, and they can be sheet-like or blade-like. For example, the elongated planar component is selected from doctor blades, headbox sheets, headbox wedges, suction roll sealings and suction box covers, which are used in a wet-end section in the manufacture of fiber webs such as paper, board or tissue.

The elongated profiled components have typically curved or bent form, or they may have an irregular shape with non-planar and often non-parallel opposite surfaces, and/or they may contain protruding parts. The elongated profiled component may be selected, for example, from rod beds used in surface sizing to hold a rotating rod, rod bed parts, foil blades, dewatering elements, such as foil lists, and holder parts for doctoring equipment.

According to one preferable embodiment the elongated planar component may be a blade, such as a doctor blade, preferably having a blade thickness in a range of 1-4 mm, preferably 2-3 mm. The elongated planar components according to the present invention are especially suitable for use as doctor blades to clean a roll surface from water and/or impurities. The elongated planar components are also especially suitable for use as pressure blades in a doctoring equipment or edge wiper blades on both edges of the web. It has been noted that the blades made from biodegradable composite, especially comprising polylactic acid, are less prone for blade wear and the blade maintains its sharpness for longer period. At the same time, it is possible to reduce the blade thickness compared to conventional ultra-high-molecular-weight polyethylene (UHMW-PE) doctor blades, typically used in the same machine positions.

The elongated component according to the present invention is at least partially, preferably completely, formed from a composite material, which comprises a continuous polymer matrix, and reinforcing inorganic fibers embedded in the continuous polymer matrix. The reinforcing inorganic fibers are inserted into and surrounded by the continuous polymer matrix. According to the present invention the continuous polymer matrix is biodegradable, and the reinforcing inorganic fibers are biodegradable glass fibers. In the present context "biodegradable" indicates that continuous polymer matrix and reinforcing fibers are degradable by biological activity, e.g., by microorganisms, such as bacteria, fungi, algae, and/or enzymes. The degradation of the continuous polymer matrix is accompanied by a lowering of the molar mass of the original polymer(s) of the polymer matrix. Preferably at least 90 weight-% of the continuous polymer matrix and reinforcing fibers are degraded into environmentally acceptable constituents, such as water, carbon dioxide and inorganic salts, preferably within 6 months.

The continuous polymer matrix may comprise any suitable biodegradable polymer or mixture of biodegradable polymers. According to one preferable embodiment, the continuous polymer matrix may comprise polylactic acid; polycaprolactone; a polyhydroxyalkanoate, such as polyhydroxybutyrate; poly(alkylene succinate), such as poly(ethylene succinate) or poly(butylene succinate); or any mixtures thereof. Preferably the continuous polymer matrix comprises at least polylactic acid, which is here understood as a copolymer of lactic acid and lactide. The weight average molecular weight of the polylactic acid may be, for example in a range from 10,000-900,000 g/mol, preferably 30,000-500,000 g/mol, more preferably from 55,000-250,000 g/mol. Polylactic acid; polycaprolactone; a polyhydroxyalkanoate, such as polyhydroxybutyrate; are produced by microorganisms, including bacteria and can be biodegraded and composted. Poly(alkylene succinate), such as poly(ethylene succinate) or poly(butylene succinate) are polymers which can be biodegraded and composted.

The composite material may comprise 50-80 weight-%, preferably 60-70 weight-%, of continuous polymer matrix.

According to one preferable embodiment the continuous polymer matrix comprises a mixture of polylactic acid and poly(alkylene succinate), preferably poly(butylene succinate). The amount of polylactic acid in the continuous polymer matrix may be 20-60 weight-%, preferably 30-55 weight-%, more preferably 40-50 weight-%. The amount of the poly(alkylene succinate) may be 40-80 weight-%, preferably 45-70 weight-%, more preferably 50-60 weight-%. The percentages are calculated from the total weight of the polymer matrix only, thus excluding the weight of the reinforcing glass fibers. It has been observed that the combination of the polylactic acid and poly(alkylene succinate) is able to provide the combination of desired mechanical properties and biodegradability which is needed for the elongated components in manufacturing machines for fibrous cellulosic webs.

The reinforcing inorganic fibers may be any biodegradable glass fibers having suitable strength and degradation properties. According to one preferable embodiment the inorganic fibers are biodegradable glass fibers comprising 60-75 weight-%, preferably 65-70 weight-%, of $SiO_2$;
5-20 weight-%, preferably 12-17 weight-%, of $Na_2O$;
5-25 weight-%, preferably 8-11 weight-%, of CaO;
0-10 weight-%, preferably 3-7 weight-%, of MgO;
0.5-5 weight-%, preferably 0.5-2.5 weight-%, of $P_2O_5$;
0-15 weight-%, preferably 1-4 weight-%, $B_2O_3$;
0-20 weight-%, preferably 0.5-4 weight-%, $K_2O$;
0-4 weight-% of SrO; and
0-1 weight-% of $Li_2O$.

According to one embodiment the biodegradable glass fibers may in addition comprise 0-5 weight-% of $Al_2O_3$.

According to another embodiment the biodegradable glass fibers comprise at most 0.3 weight-% of $Al_2O_3$+$Fe_2O_3$.

According to one embodiment the composite material may comprise 10-40 weight-%, preferably 10-30 weight-%, of biodegradable glass fibers.

The inorganic fibers may be chopped biodegradable glass fibers, which have a fiber length 0.5-3 mm. The chopped biodegradable glass fibers are preferably randomly and uniformly embedded in the continuous polymer matrix. The fine particle size of the chopped biodegradable glass fibers provides smooth and uniform structure for the elongated component made from the composite material, which is advantageous in terms of non-marking of the fibrous web, machine clothing or roll surface. An elongated component comprising composite with chopped biodegradable glass fibers can be easily prepared by melting granulates of suitable biodegradable polymer(s), mixing the chopped glass fibers with the polymer melt in an extruder and forming the desired elongated components by extrusion.

According to one embodiment the inorganic fibers may be continuous biodegradable glass fibers forming at least one woven structure embedded in the continuous polymer matrix. The elongated component may comprise one or more layers of unidirectional or woven structures of reinforcing fibers embedded in the continuous polymer matrix. The elongated components may be formed by preparing a prepreg comprising the biodegradable matrix polymer and oriented biodegradable glass fibers, followed by pressing the prepreg under the influence of heat and increased pressure whereby the elongated component with desired shape and dimensions is formed of composite material. Pultrusion and press technology are also possible techniques for forming the composite material when continuous glass fibers are used. Other suitable techniques are vacuum injection, resin transfer molding and sheet molding compound process.

The composite material may further comprise additional filler particles, preferably mineral filler particles, embedded in the continuous polymer matrix. The composite material my comprise 0-30 weight-%, preferably 0.1-30 weight-%, of additional filler particles, preferably mineral filler particles. The additional filler particles may be mixed with chopper biodegradable glass fibers before blending into the polymer matrix. The composite material may comprise additional filler particles of one type, or it may comprise a mixture of different additional filler particles. The additional filler particles may preferably be selected from inorganic mineral filler particles, such as particles of silica, silicon carbide, carbon black, titanium oxide, feldspar, kaolin. It is possible that the additional filler particles may comprise organic particles, such as particles of aramid or polyethylene or rubber. In some embodiments the additional filler particles may have an average particle diameter over 5 μm, preferably in the range of 10-300 μm. It is also possible to use nanosized additional filler particles, which have an average particle diameter <1 μm, for example 5-40 nm. Nanosized additional filler particles can be used alone or together with larger additional filler particles. Use of one or more additional filler particles make it possible to adjust the mechanical properties of the composite material. However, the use of additional filler particles is fully optional.

The composite material may preferably have a heat deflection temperature of ≥85° C., preferably ≥90° C., more preferably ≥95° C., even more preferably ≥100° C., determined according to standard ISO 75 method A.

The composite material may preferably have

- a value for tensile strength at break at least 50 MPa, preferably 60-80 MPa, determined according to standard ISO 527; and/or
- a tensile modulus value of at least 7500 MPa, preferably 7800-8800 MPa, determined according to standard ISO 527; and/or
- a distortion value ≤0.3 mm/m; and/or
- flexural modulus value of at least 7300 MPa, preferably 7400-7600 MPa, determined according to standard ISO 178.

According to one embodiment the invention relates even to an arrangement for a manufacturing machine of a fibrous cellulosic web, such as paper, board or tissue web, which arrangement comprises an elongated planar or profiled component and at least one connection means, such as holder, clamp or the like, for supporting the elongated component in the manufacturing machine, where both the elongated component and the at least one connection device or means comprise or consist of biodegradable composite, as describe in this context.

According to one embodiment the invention further relates to the use of a composite material comprising a continuous polymer matrix and inorganic reinforcing fibers selected from biodegradable glass fibers embedded in the continuous matrix for elongated planar and/or profiled components used for manufacture of a fibrous web, such as paper, board, tissue, or the like.

One of the great advantages of the present invention is that the elongated planar or profiled components formed from composite material comprising biodegradable continuous polymer matrix and inorganic reinforcing fibers selected from biodegradable glass fibers can be easily recycled after their use. After the estimated operational life of the elongated component is run out, the elongated component is detached from the manufacturing machine. The detached elongated components can be collected, and optionally sorted. At the sorting stage possible non-degradable parts may be removed.

The composite parts of the elongated components are processed into a starting composite material, e.g., by melting the continuous polymer matrix of the composite material. The starting composite material thus comprises biodegradable polymer(s) and biodegradable glass fibers, and optional additional filler particles, preferably mineral filler particles. The starting composite material may then be formed into a second elongated component, e.g., by extruding. The obtained second elongated component comprises at least biodegradable glass fibers embedded in the biodegradable polymer matrix and is suitable for use in the manufacture of fibrous cellulosic webs.

Preferably the processing of the collected elongated components may comprise washing and comminuting the composite parts of elongated components into composite particles before their processing into the starting composite material.

Typically the collected elongated components have a first set of material and/or mechanical properties, such as average fiber length of the reinforcing fibers. The processing of the collected elongated fibers may change the material and/or mechanical properties, which means that the formed second elongated components have a second set of material and/or mechanical properties. Typically, material and/mechanical properties, such as average fiber length of the reinforcing fibers, may be reduced during the processing. This means that the collected first elongated components usually have higher material and/or mechanical properties than the formed second elongated components. According to one preferable embodiment the collected elongated components are doctor blades, which are processed into second elongated components, such as headbox sheets or headbox wedges. The present invention thus provides a possibility to effectively recycle higher grade composite elements into lower grade composite elements. The recycling can be continued as long as the material and mechanical properties of the formed second components fulfil the requirements of the manufacturing process. Finally, the material may be composted in an industrial composter.

The following schematical non-limiting drawings further demonstrate certain aspects of the present invention. The invention may be better understood by reference to the drawings in combination with the detailed description of the embodiments presented herein.

DESCRIPTION OF THE PREFERRED EMBODIMENTS

Figure 1:
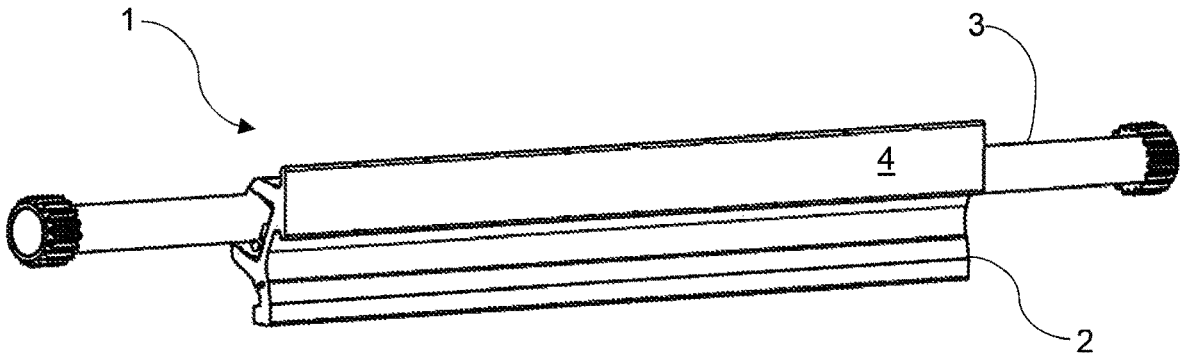
FIG. 1 shows schematically a first example of an elongated profiled component for a manufacturing machine of a fibrous cellulosic web according to one embodiment of the present invention.

In FIG. 1 is seen a rod-bed assembly 1, which comprises a first example of an elongated profiled component, which is a rod-bed 2. The rod-bed assembly 1 further comprises a rod 3 for dosing a coating or sizing medium in a coating or sizing device (not shown). The rod 3 is rotatably supported by the rod-bed 2. The rod-bed 2 comprises an elongated profiled body 4 with a recess adapted to receive the rotatable rod 3. The elongated profiled body 4 of the rod bed is formed from a biodegradable composite material comprising a continuous polymer matrix and reinforcing glass fibers embedded in the continuous polymer matrix, wherein both the polymer matrix and the reinforcing fibers are biodegradable.

Figure 2:
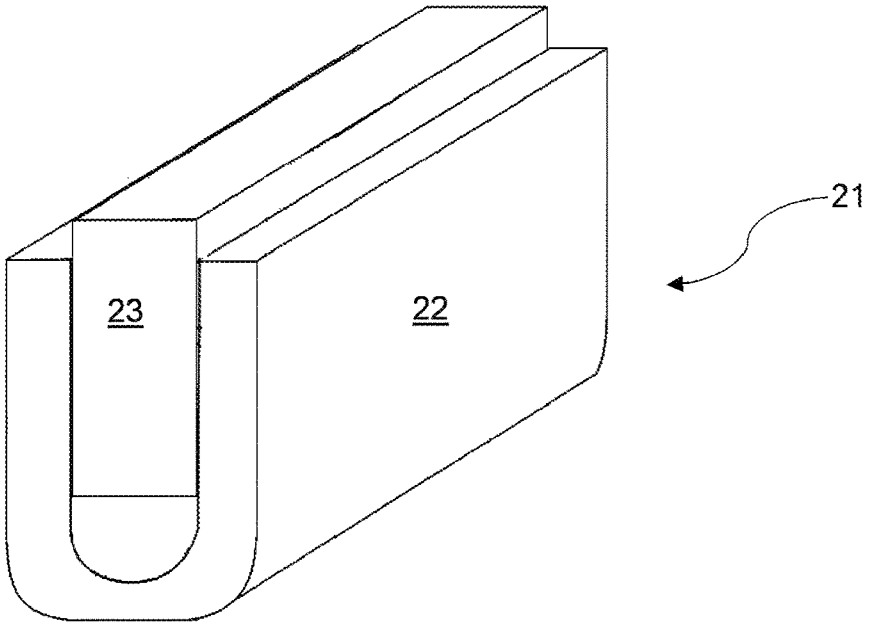
FIG. 2 shows schematically a second example of an elongated profiled component for a manufacturing machine of a fibrous cellulosic web according to one embodiment of the present invention.

In FIG. 2 is seen a sealing arrangement 21 for a suction roll (not shown). The sealing arrangement comprises a seal holder 22 and a sealing element 23 arranged in the seal holder 22. Both the seal holder 22 and the sealing element 23 extend essentially over the length of the suction box. The second example of an elongated planar component according to the present invention is the sealing element 22, which is formed from a biodegradable composite material comprising a continuous polymer matrix and reinforcing glass fibers embedded in the continuous polymer matrix, wherein both the polymer matrix and the reinforcing fibers are biodegradable.

Figure 3:
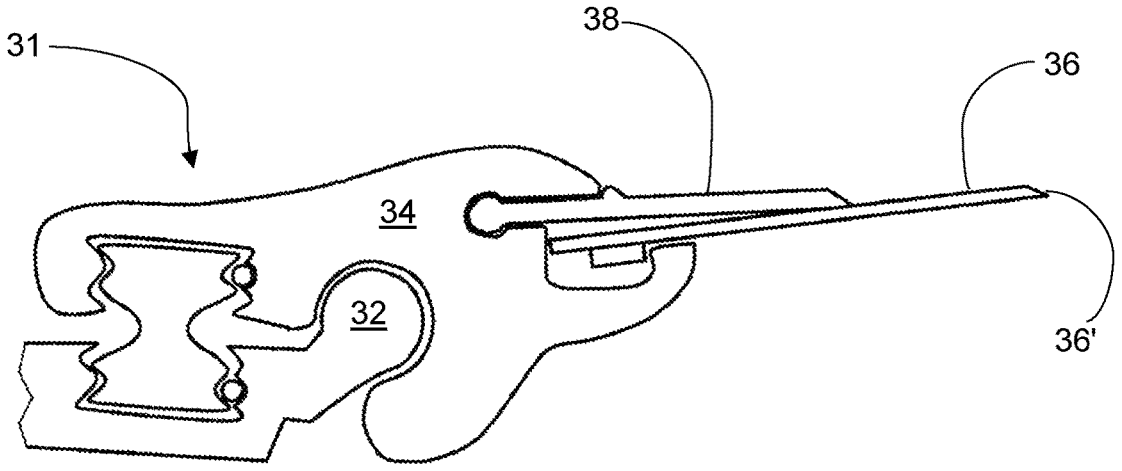
FIG. 3 shows schematically a third example of an elongated profiled component for a manufacturing machine of a fibrous cellulosic web according to one embodiment of the present invention.

In FIG. 3 is seen a doctor arrangement 31 suitable for use in a manufacture of a fibrous cellulosic webs, such as paper, board, tissue, or the like. The doctor arrangement 31 comprises a frame component 32 to which a blade holder 34 is connected. A doctor blade 36 and a pressure plate 38 are arranged to the blade holder 34. The doctor blade 36 provides the third example of an elongated planar component according to the present invention. The doctor blade is formed from a biodegradable composite material comprising a continuous polymer matrix and reinforcing glass fibers embedded in the continuous polymer matrix, wherein both the polymer matrix and the reinforcing fibers are biodegradable. The tip 36' of the doctor blade 36 made from biodegradable composite material is less prone to wear and the blade maintains its sharpness for a longer period. It is also possible to form the blade holder 34, pressure plate 38 and/or the frame component 32 from a biodegradable composite material in accordance with the present invention. In this manner the amount of biodegradable material can be significantly increased in the manufacturing process of paper, board, tissue or the like.

Figure 4:
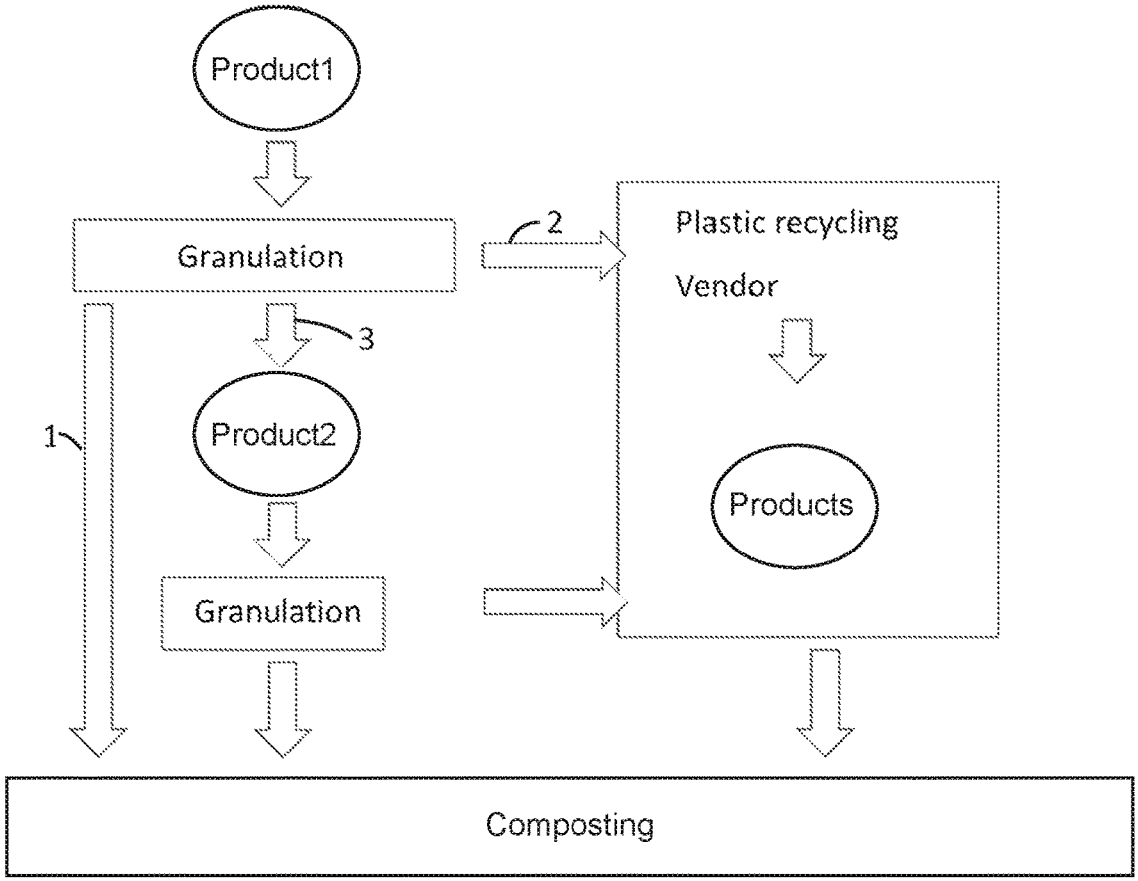
FIG. 4 shows schematically a possible life cycle of an elongated planar or profiled component according to the present invention.

FIG. 4 shows schematically a possible life cycle of an elongated planar or profiled component according to the present invention, named as "Product1". After its working life has come to an end Product1 is granulated or comminuted. After granulation, the obtained granules can be disposed of by composting (arrow 1). Alternatively obtained granules can be taken care of by a plastic recycling vendor, who can use the granules for manufacture of new products (arrow 2). After their use, these new products can also be disposed of by composting. According to a further alternative, the granules from Product1 can be used for production of a new elongated planar or profiled component, here denoted "Product2" (arrow 3). Typically, the Product2 has lower material requirements than Product1. After the working life of Product2 ends, it can be granulated or comminuted and preferably disposed of by composting.

EXPERIMENTAL

Some embodiments of the invention are described in the following non-limiting experiments.

Blade samples according to the invention were compared with blades made of materials typically used in prior art doctor blades. Blade samples of 5 different material compositions A-E were made as follows.

- Sample A (Comparative example): UHMW-PE—unreinforced, a piece of a commercial doctor blade;
- Sample B: 70 weight-% of biodegradable resin (matrix), reinforced with 30 weight-% of chopped biodegradable glass fibers;
- Sample C (Comparative example): 70 weight-% of biodegradable resin (matrix) and 30 weight-% of mineral filler;
- Sample D (Comparative example): epoxy resin matrix, reinforced by non-biodegradable E-glass fiber, a piece of a commercial doctor blade
- Sample E: 60 weight-% of biodegradable resin (matrix), reinforced with 10 weight-% of chopped biodegradable glass fibers and 30 weight-% of mineral filler particles.

The length and width of each blade sample A to E was identical, 75 mm×20 mm, with blade stick-out of 40 mm simulating true operation of a doctor blade while in its holder. The tip of the blades was bevelled to provide maximum sharpness and cleaning effect.

Experiment 1

Test equipment comprised of a PU-covered test roll, i.e., a Polyurethane covered roll, of Shore hardness 10.6 P&J. The roll was rotated with a speed of 1000 m/min. Samples A-D were tested simultaneously by holding each sample by its holder in a contact against the roll surface with a blade angle 25° and line pressure 180 N/m. Water lubrication on the roll surface was provided by a water shower. The roll was rotated for 2 weeks after which the samples were removed. The blades were visually inspected of their wear and of keeping the tip sharpness/bevel shape. Also, the surface of the roll was visually inspected for any damage or if traces or residuals of the blade material was left on the surface. Results are shown in Table 1 below.

Experiment 2

In Experiment 2 Sample B according to the invention and the comparative Sample C were tested for their applicability for recycling as a raw material for manufacturing of new products. The samples B and C were compared for maintaining their mechanical properties after exposure to wet conditions for several weeks. The Shore D hardness, ISO 178 flexural strength and flexural modulus of samples were measured before and after immersing in 40° C. water for 4 weeks. Results are shown in Table 1 below.

TABLE 1

Results of Experiments 1 and 2

| Sample | Blade thickness [mm] | Blade wear | Blade sharpness | Roll surface quality, residuals | Shore D Hardness before/after | Flexural strength [MPa] before/after | Flexural Modulus [MPa] before/after |
|---|---|---|---|---|---|---|---|
| A (Ref.) | 5 | major | major loss | some | — | — | — |
| B | 4 | none/minor | kept | no | 74/72 | 131/72 | 7520/5340 |
| C (Ref.) | 4 | none/minor | kept | no | 77/73 | 99/65 | 6130/4560 |
| D (Ref.) | 2 | none/minor | kept | no | — | — | — |

Experiment 3

Samples and test arrangement were the same as in Experiment 1. The focus was on optimizing blade thickness further in order to minimise the material usage. The comparative samples A and D had a thickness that is typically used in commercial blades made of that material, but the blade thickness of samples B, C and E was varied. Doctoring performance was monitored by inspecting the ability of the sample to keep the roll surface dry of the water as blade wear and warp both result in failure to keep the roll surface dry. Blade warp or bend was visually compared to that of the non-biodegradable glass fiber blade (comparative sample D). Blade wear and roll surface quality were inspected as in Experiment 1. Results are shown in Table 2.

TABLE 2

Results of Experiment 3.

| Sample | Blade thickness [mm] | Doctoring failed after/days | Blade wear | Blade warp | Roll surface quality, residuals |
|---|---|---|---|---|---|
| A (Ref.) | 5 | 3 | major | — | some |
| B | 3 | >14 | none/minor | no | no |
| B | 2 | >14 | none/minor | no | no |
| C (Ref.) | 3 | 6 | non-acceptable | yes | some |
| C (Ref.) | 2 | 3 | non-acceptable | yes | some |
| D (Ref.) | 2 | >14 | none/minor | no | no (but roll surface fine-grooved) |
| E | 3 | >14 | none/minor | no | no |
| E | 2 | 12 | none/minor | yes | no |

It can be seen from results in Table 2 blades according to the invention have competitive properties compared with the conventional blades of the prior art. Sufficient stiffness properties were achieved with optimized thickness. A low thickness was desired not only in order to reduce the amount of material and thus the amount of waste but also for improved doctoring performance. The thin blade according to the invention is less prone to lose its bevelled tip and thus less prone to hydroplaning or floating. It keeps a good contact with the surface to be doctored and still without damaging the roll surface or leaving rubbed residuals on the surface during contact.

Despite its biodegradable nature the composite material used in the blades of the invention maintains certain mechanical properties that are important in terms of recycling as a raw material. Especially surface hardness is maintained after exposure to water and wet conditions. Strength properties are decreased but not too much for not being applicable to a second round as raw material, especially for a component with less demanding requirements. For material used in Samples B and C it has been found that a drop in mechanical properties is remarkable only after the second or third melting. Comparative Sample C with mineral filler but without biodegradable glass fiber reinforcement performed acceptably with a blade thickness of 4 mm (Table 1) but when the blade thickness was reduced to 3 or 2 mm, it failed (Table 2). Inventive Samples B (with biodegradable glass fiber, without mineral filler) and E (with mineral filler and biodegradable glass fibers in proportion of 3:1) achieved a good performance level even with blade thickness of 2 mm, as seen from Table 2. Thus, it was concluded that the presence of biodegradable glass fibers is advantageous in doctor blades. Samples B and E according to the invention even seemed to exceed the prior art Sample D in terms of maintaining roll surface quality during doctoring.

Even if the invention was described with reference to what at present seems to be the most practical and preferred embodiments, it is appreciated that the invention shall not be limited to the embodiments described above, but the invention is intended to cover also different modifications and equivalent technical solutions within the scope of the enclosed claims.

We claim:

1. A doctor blade for a fibrous cellulose web manufacturing machine, the doctor blade extending in a cross-machine direction and a machine direction and having a doctor blade thickness, the doctor blade comprising:

a continuous polymer matrix comprised of at least one of polylactic acid; polycaprolactone; a polyhydroxyalkanoate, polyhydroxybutyrate; poly(alkylene succinate), and poly(butylene succinate); and reinforcing inorganic biodegradable glass fibers embedded in the continuous polymer matrix; wherein the doctor blade thickness is in a range of 1-4 mm.

2. The doctor blade of claim 1 wherein the composite material further comprises mineral filler particles embedded in the continuous polymer matrix.

3. The doctor blade of claim 1 wherein the composite material comprises:

50-80 weight-% of polymer matrix;

10-50 weight-% of inorganic fibers; and 0-30 weight-% of mineral filler particles.

4. The doctor blade of claim 3 wherein the composite material comprises:

60-70 weight-% of polymer matrix;

10-30 weight-% of inorganic fibers; and 0.1-30 weight-% of mineral filler particles.

5. The doctor blade of claim 1 wherein the component is a doctor blade having a blade thickness in a range of 2-3 mm.

6. The doctor blade of claim 1 wherein the inorganic fibers are chopped biodegradable glass fibers, which have a fiber length of 0.5-3 mm.

7. The doctor blade of claim 6 wherein the biodegradable glass fibers are randomly and uniformly embedded in the continuous polymer matrix.

8. The doctor blade of claim 1 wherein the inorganic fibers are continuous biodegradable glass fibers forming at least one woven structure embedded in the continuous polymer matrix.

9. The doctor blade of claim 1 wherein the doctor blade is formed of material having a property selected from the group consisting of:

a heat deflection temperature of ≥85° C. determined according to standard ISO 75 method A;

a value for tensile strength at break of at least 50 MPa determined according to standard ISO 527;

a tensile modulus value of at least 7500 MPa determined according to standard ISO 527;

a distortion value ≤0.3 mm/m; and a flexural modulus value of at least 7300 MPa determined according to standard ISO 178.

10. A method of manufacture of a fibrous cellulosic web, comprising:

on a web manufacturing machine employing at least one doctor blade which extends in a cross-machine direction and a machine direction and having a doctor blade thickness in a range of 1-4 mm; and wherein the at least one doctor blade has a biodegradable continuous polymer matrix comprised of at least one of polylactic acid; polycaprolactone; a polyhydroxyalkanoate, polyhydroxybutyrate; poly(alkylene succinate), and poly(butylene succinate), and wherein reinforcing inorganic fibers of biodegradable glass fibers are embedded in the continuous polymer matrix.

* * * * *